US010443920B2

(12) United States Patent
Chen et al.

(10) Patent No.: US 10,443,920 B2
(45) Date of Patent: Oct. 15, 2019

(54) MULTIFUNCTIONAL CHAMBER AND REFRIGERATOR

(71) Applicant: QINGDAO HAIER JOINT STOCK CO., LTD, Qingdao, Shandong (CN)

(72) Inventors: Kexin Chen, Shandong (CN); Weiying Zhang, Shandong (CN); Enwei Ding, Shandong (CN); Min Li, Shandong (CN); Aimin Wang, Shandong (CN); Guoxin Yu, Shandong (CN)

(73) Assignee: Qingdao Haier Joint Stock Co., Ltd., Quingdao (CN)

( * ) Notice: Subject to any disclaimer, the term of this patent is extended or adjusted under 35 U.S.C. 154(b) by 124 days.

(21) Appl. No.: 15/528,627

(22) PCT Filed: May 30, 2015

(86) PCT No.: PCT/CN2015/080431
§ 371 (c)(1),
(2) Date: May 22, 2017

(87) PCT Pub. No.: WO2016/082505
PCT Pub. Date: Jun. 2, 2016

(65) Prior Publication Data

US 2017/0261249 A1 Sep. 14, 2017

(30) Foreign Application Priority Data

Nov. 28, 2014 (CN) ..... 2014 1 0702107

(51) Int. Cl.
*F25D 17/04* (2006.01)
*F25D 23/12* (2006.01)
*F25D 25/02* (2006.01)

(52) U.S. Cl.
CPC ..... *F25D 17/042* (2013.01); *F25D 17/045* (2013.01); *F25D 23/12* (2013.01);
(Continued)

(58) Field of Classification Search
CPC ..... F25D 23/12; F25D 17/042; F25D 17/045; F25D 25/025; F25D 2317/0411;
(Continued)

(56) References Cited

U.S. PATENT DOCUMENTS 4,745,775 A * 5/1988 Bussan ..... F25D 25/024 312/321.5
4,751,826 A * 6/1988 Kawahara ..... F25D 11/02 62/382
(Continued)

FOREIGN PATENT DOCUMENTS

CN 102679679 A 9/2012
CN 102818413 A 12/2012
(Continued)

OTHER PUBLICATIONS

"Machine Translation of JP 2012255609A, Shibata, Dec. 2012."*
(Continued)

*Primary Examiner* — Frantz F Jules
*Assistant Examiner* — Martha Tadesse
(74) *Attorney, Agent, or Firm* — Ladas & Parry LLP

(57) ABSTRACT

Provided is a multifunctional chamber and a refrigerator. The chamber comprises a door body, an inner container enclosed by a plurality of plate bodies, at least one opening provided in at least one of the plurality of plate bodies, a moisture preserving module disposed at the opening and used for regulating and controlling the humidity of the chamber, an upper cover movably disposed on the moisture preserving module, and at least one air port provided in at least one of the plurality of plate bodies and used for discharging moisture from the chamber. When the chamber is at a high-humidity mode, the upper cover moves at the moisture preserving module to expose the moisture preserving module; and when the chamber is at drying mode, the
(Continued)

upper cover completely covers the moisture preserving module.

8 Claims, 3 Drawing Sheets

(52) U.S. Cl.
CPC .... *F25D 25/025* (2013.01); *F25D 2317/0411* (2013.01); *F25D 2317/0413* (2013.01); *F25D 2317/04111* (2013.01); *F25D 2317/04131* (2013.01)

(58) Field of Classification Search
CPC ... F25D 2317/0413; F25D 2317/04131; F25D 2317/04111
See application file for complete search history.

(56) References Cited

U.S. PATENT DOCUMENTS 4,788,832 A * 12/1988 Aoki ..... F25D 17/065 62/382
4,959,976 A * 10/1990 Matsuda ..... F25B 21/02 34/625
5,918,480 A * 7/1999 Nagata ..... A23B 7/0425 62/440
2003/0010056 A1* 1/2003 Sakamoto ..... F25D 17/065 62/441
2005/0241483 A1* 11/2005 Okada ..... B01D 53/02 96/134
2014/0300264 A1 10/2014 Park et al.

FOREIGN PATENT DOCUMENTS

CN 104567191 A 4/2015
JP H01123981 A 5/1989
JP H05157443 A 6/1993
JP H063043 A 1/1994
JP 2010139183 A * 6/2010
JP 2010139183 A 6/2010
JP 2012255609 A * 12/2012
JP 2012255609 A * 12/2012 ..... F25D 25/025

OTHER PUBLICATIONS

CN 102818413 A English Abstract.
CN 102679679 A English Abstract.
CN 104567191 A English Abstract.
JP H01123981 A English Abstract.
JP H063043 A English Abstract.
JP H05157443 A English Abstract.
JP 2010139183 A English Abstract.

* cited by examiner

MULTIFUNCTIONAL CHAMBER AND REFRIGERATOR

This application is a national phase entry under 35 USC 371 of International Patent Application No.: PCT/CN2015/080431 filed on 30 May 2015, which claims priority from Chinese Application No. 201410702107.0, filed on 28 Nov. 2014 and entitled "MULTIFUNCTIONAL CHAMBER AND REFRIGERATOR", which is incorporated by reference in its entirety in the present application.

TECHNICAL FIELD

The present invention relates to a refrigerator, in particular to a multifunctional chamber and a refrigerator.

BACKGROUND OF THE INVENTION

At present, refrigerator and freezer products can carry a drying chamber or a high-humidity chamber so that a user stores foods and medicinal materials which have strict requirements on the humidity. In a general case, the drying chamber can only provide a dry environment, and the high-humidity chamber can only provide a high-humidity environment, so that the user cannot flexibly adjust the using environment of each chamber according to the requirements, thus leaving a chamber unused to cause the waste of space of the refrigerator.

SUMMARY OF THE INVENTION

In order to solve the above-mentioned problem, one purpose of the present invention is providing a multifunctional chamber and a refrigerator.

In order to achieve one of the above-mentioned inventive purposes, one embodiment of the present invention provides a multifunctional chamber, comprising an inner container and a door body for closing said inner container, said inner container being surrounded by a plurality of plate bodies, and said chamber further comprising:

at least one opening provided in at least one of the plurality of plate bodies;

a moisture preserving module provided at said opening, and said moisture preserving module being used to regulate and control the humidity of said chamber;

an upper cover movably disposed on said moisture preserving module;

and at least one air port provided in at least one of the plurality of plate bodies, said air port being used to discharge moisture from said chamber;

wherein when said chamber is at a high-humidity mode, said upper cover moves at said moisture preserving module to expose said moisture preserving module; and when said chamber is at a drying mode, said upper cover completely covers said moisture preserving module.

As a further improvement of an embodiment of the present invention, said moisture preserving module has a moisture-permeable humidity value, and when is a current humidity value of said chamber is greater than said moisture-permeable humidity value, said moisture preserving module allows the moisture in said chamber to flow out; and when said current humidity value is not greater than said moisture-permeable humidity value, said moisture preserving module prevents the moisture in said chamber from flowing out.

As a further improvement of an embodiment of the present invention, when said chamber is in said high-humidity mode, said moisture preserving module regulates said current humidity value of said chamber, and said current humidity value is gradually approaching said moisture-permeable humidity value and is consistent with said moisture-permeable humidity value.

As a further improvement of an embodiment of the present invention, said moisture preserving module is arranged in a sealed manner at said opening.

As a further improvement of an embodiment of the present invention, said moisture preserving module comprises at least two bases and at least one moisture preserving film, said moisture preserving film is sandwiched between said bases, and said base is provided with at least one air hole.

As a further improvement of an embodiment of the present invention, said moisture preserving module or the plate body provided with said moisture preserving module is provided with a first sliding part, said upper cover is provided with a second sliding part corresponding to the first sliding part, and said upper cover slides relative to said moisture preserving module by means of said first sliding part and said second sliding part.

As a further improvement of an embodiment of the present invention, one of said first sliding part and said second sliding part is a chute, and the other of said first sliding part and said second sliding part is a boss.

As a further improvement of an embodiment of the present invention, said moisture preserving module or the plate body provided with said moisture preserving module is provided with at least one blocking part, and said blocking part is used to prevent said upper cover from being detached from said moisture preserving module.

As a further improvement of an embodiment of the present invention, said chamber further comprises an air supply module and an evaporator, said at least one air port is an air inlet, said evaporator is used to generate dry air, and when said chamber is at a drying mode, said air supply module blows said dry air into said chamber via said air inlet.

In order to achieve one of the above-mentioned purposes, provided is a refrigerator comprising a multifunctional chamber mentioned above.

Compared with the prior art, the beneficial effects of the present invention are: in the present invention, the same chamber can switch between the high-humidity mode and the drying mode according to the humidity requirement of the stored products, thereby achieving an object of flexibly adjusting chamber environment and reducing the waste of chamber.

REFERENCE SIGNS

Figure 1:
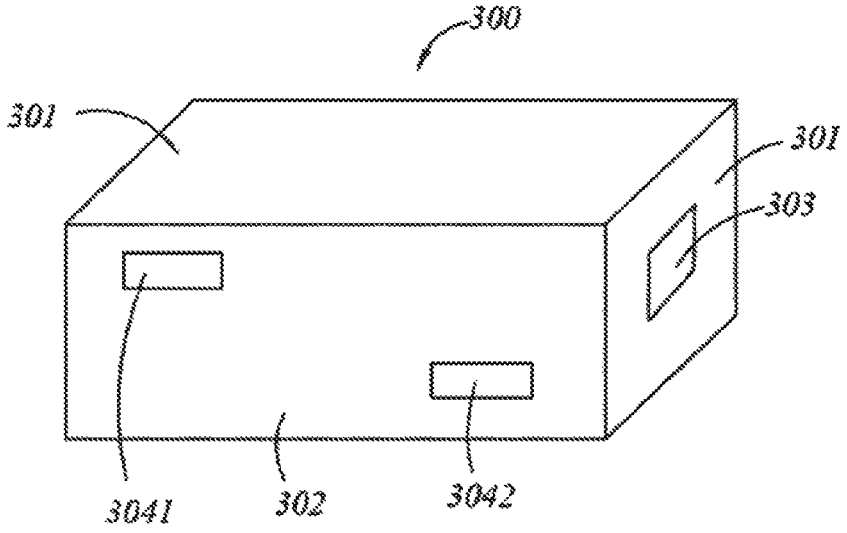
FIG. 1 is a dimensional structural schematic view of a chamber of an embodiment of the present invention.

100: Chamber;
200: Door body;
300: Inner container;
301: Side wall;
302: Rear wall;
303: Moisture preserving module;
3031: First base;
3032: Second base;
3033: Moisture preserving film;
3034: Air hole;
3035, 3035': First sliding part;
3036: Blocking part;
3037: Limiting part;
304: Air port;
3041: Air inlet;
3042: Air outlet,
305: Air supply module;
3051: Air channel;
306: Shield door;
307: Roller;
308: Slide rail;
309: Drawer;
310: Upper cover;
3101, 3101': Second sliding part;
311: Opening;
400: Sealing gasket;
Hn: Moisture-permeable humidity value;
H1, H2: Current humidity value.

DETAILED DESCRIPTION OF THE INVENTION

The present invention will be described below in detail in combination with particular embodiments as shown in the drawings. However, these embodiments are not limited to the present invention, and the structures, methods or functional changes made according to these embodiments by a person skilled in the art shall be included within the scope of protection of the present invention.

Figure 2:
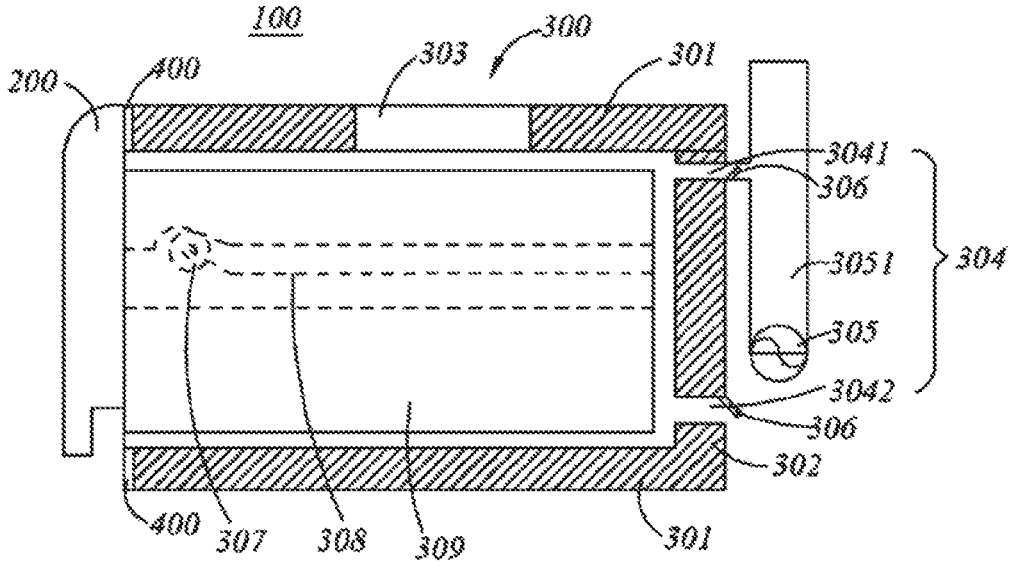
FIG. 2 is a sectional structural schematic view of a chamber of an embodiment of the present invention.
Figure 3:
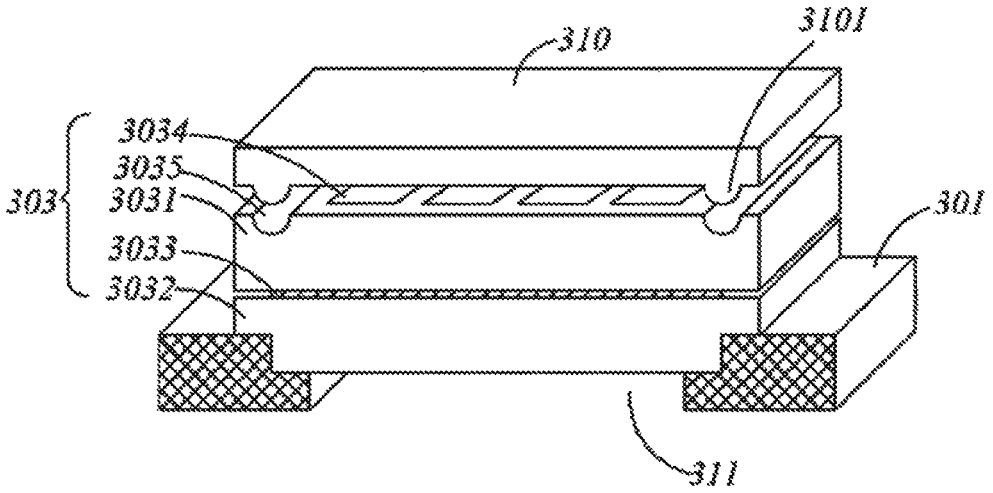
FIG. 3 is a partial structural schematic view of a chamber of an embodiment of the present invention.

As shown in FIG. 1 to FIG. 3, a multifunctional chamber 100 of an embodiment of the present invention comprises an inner container 300 and a door body 200 for closing said inner container 300, wherein said inner container 300 is surrounded and formed by a plurality of plate bodies, said plate bodies include, for example, side walls 301 and a rear wall 302, and said chamber 100 further comprises at least one opening 311, a moisture preserving module 303, an upper cover 310 and at least one air port 304; at least one opening 311 is provided in at least one of the plurality of plate bodies; the moisture preserving module 303 is disposed at said opening 311, and said moisture preserving module 303 is used for regulating and controlling the humidity of said chamber 100; the upper cover 310 is movably disposed on said moisture preserving module 303; at least one air port 304 is provided in at least one of the plurality of plate bodies, and said air port 304 is used for discharging moisture from said chamber 100; and when said chamber 100 is at a high-humidity mode, said upper cover 310 moves at said moisture preserving module 303 to expose said moisture preserving module 303, and when said chamber 100 is at a drying mode, said upper cover 310 completely covers said moisture preserving module 303.

In the present embodiment, the joints of the door body 200 and the inner container 300 are all provided with sealing gaskets 400, and the sealing gaskets 400 are used to prevent matters, such as gas and moisture, in the chamber 100 from overflowing from the door body 200. The inner container 300 can be provided with a drawer 309 therein, the drawer 309 can slide in said inner container 300 by means of a roller 307 and a slide rail 308, and said drawer 309 is used to place products to be stored. Said drawer 309 goes down under the action of gravity to press the sealing gaskets 400 for tight sealing between the door body 200 and the inner container 300.

In the present embodiment, the moisture preserving module 303 is arranged, but not limited to be, at the side wall 301, the position and number of the moisture preserving module 303 can be determined according to actual situations. The moisture preserving module 303 comprises a first base 3031, a second base 3032 and a moisture preserving film 3033, the first base 3031 and the second base 3032 are stacked one above another, said moisture preserving film 3033 is sandwiched between the first base 3031 and the second base 3032, and the fixing method of said moisture preserving film 3033 to the first base 3031 and the second base 3032 is not limited, such as using a nail or an adhesive agent for fixation.

In the present embodiment, since the moisture preserving film 3033 is a relatively thin film layer, the moisture preserving film 3033 is prone to rupture, and the moisture preserving film 3033 is not easy to be fixed to said side wall 301; therefore, it is not suitable to directly fix the moisture preserving film 3033 to the opening 311. Therefore, the present embodiment uses the first base 3031 and the second base 3032 to clamp said moisture preserving film 3033 so as to prevent said moisture preserving film 3033 from rupture, and said second base 3032 is fixed to the opening 311 on said side wall 301, thereby achieving an object of fixing the moisture preserving film 3033.

In the present embodiment, said second base 3032 can be fixed to said side wall 301 by means of such as snap-fitting or adhering, in order to prevent matters, such as moisture, in the chamber 100 from overflowing from the position where the second base 3032 is fixed to the side wall 301, said second base 3032 is arranged in a sealed manner at said side wall 301, for example, a sealing gasket is arranged between said second base 3032 and said side wall 301, as shown in FIG. 3, the edge of said second base 3032 is of a stepped shape and is fitted to the step at the opening 311 of said side wall 301, so as to further enhance the sealing effect and fixing effect.

In the present embodiment, when the moisture preserving module 303 enables matters, such as moisture, in the chamber 100 to penetrate, the moisture preserving module 303 can achieve the purpose of regulating the humidity in the chamber 100. The present embodiment is provided with at least one air hole 3034 on each of the first base 3031 and the second base 3032, the air hole 3034 penetrates said first base 3031 and the second base 3032, the opening direction of the air hole 3034 on the first base 3031 is consistent with that on the second base 3032, and the moisture preserving film 3033 itself enables matters, such as moisture, to pass through; therefore, matters, such as moisture, in the chamber 100 can be interchanged with that outside the chamber 100 via the air holes 3034 on the first base 3031 and the second base 3032 and the moisture preserving film 3033. The number and position of the air hole 3034 can be determined according to actual situations.

Figure 4:
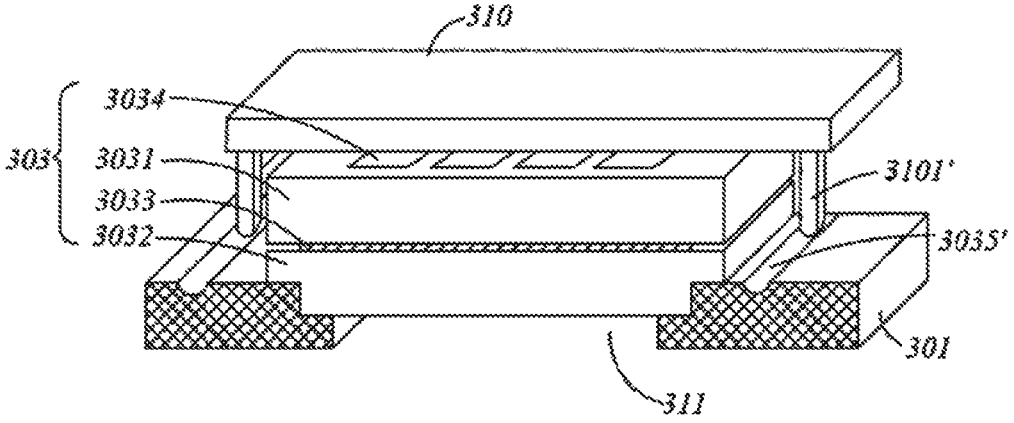
FIG. 4 is a partial structural schematic view of a chamber of an embodiment of the present invention.
Figure 5:
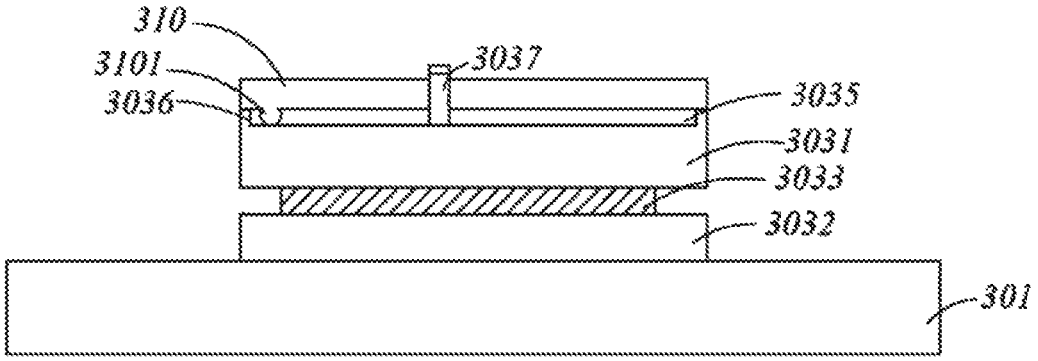
FIG. 5 is a structural schematic view of an upper cover at a first position of a moisture preserving module of an embodiment of the present invention.

As shown in FIG. 3 to FIG. 5, the first base 3031 of said moisture preserving module 303 is provided with a first sliding part 3035, said upper cover 310 is provided with a second sliding part 3101 corresponding to the first sliding part 3035, and said upper cover 310 slides on said moisture preserving module 303 by means of said first sliding part 3035 and said second sliding part 3101. In the present embodiment, said first sliding part 3035 is a chute 3035, said second sliding part 3101 is a boss 3101, and said boss 3101 can slide in said chute 3035. However, the present invention is not limited to this embodiment, and the specific structure of the first sliding part 3035 and said second sliding part 3101 can be determined according to actual situations. In other embodiments, as shown in FIG. 4, said first sliding part 3035' can be arranged on said side wall 301 close to said moisture preserving module 303, the second sliding part 3101' on said upper cover 310 protrudes, from two sides, out of said moisture preserving module 303 and is fitted to the first sliding part 3035' on the side wall 301, and since the first base 3031 at this time is not provided with the first sliding part 3035, an air-permeable region on the first base 3031 is enlarged, such that an air-permeable region on the moisture preserving module 303 is enlarged.

Figure 6:
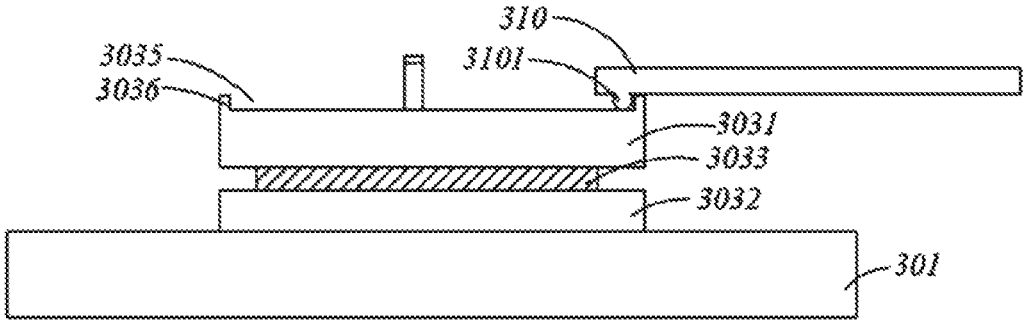
FIG. 6 is a structural schematic view of an upper cover at a second position of a moisture preserving module of an embodiment of the present invention.

In the present embodiment, in order to prevent said upper cover 310 from being detached from said moisture preserving module 303 in the sliding process, as shown in FIG. 5 and FIG. 6, two ends of said chute 3035 are provided with a blocking part 3036, said blocking part 3036 may be, but not limited to, for example, two end edges of said chute 3035, and said blocking part 3036 may also be arranged on the side wall 301 as shown. When said boss 3101 slides back and forth in said chute 3035, with the blocking function of said blocking part 3036, the boss 3101 will not slide off said chute 3035, that is, said upper cover 310 will not leave said moisture preserving module 303 in the sliding direction. In order to further prevent the upper cover 310 from leaving said moisture preserving module 303 in the vertical direction, i.e., the direction where said first base 3031 and the second base 3032 are stacked, said moisture preserving module 303 or the side wall 301 as shown may also be provided with a limiting part 3037, in FIG. 5, taking an example that the limiting part 3037 is arranged on said moisture preserving module 303, said limiting part 3037 may be a hook, with one end thereof connected to said moisture preserving module 303 and the other end thereof protruding to the upper surface of said upper cover 310, and said limiting part 3037 limits the axial movement of said upper cover 310.

As shown in FIG. 2, said chamber 100 of the present embodiment further comprises an air supply module 305, the air supply module 305 is a fan for example, said at least one air port 304 comprises an air inlet 3041 and an air outlet 3042, when said chamber is at a drying mode, at least one of said air inlet 3041 and the air outlet 3042 is in a opening state, said air supply module 305 discharges moisture from said chamber 100 via said air inlet 3041 and/or said air outlet 3042. In the present embodiment, said air inlet 3041 is connected to said air supply module 305 via an air channel 3051, said air inlet 3041 and the air outlet 3042 are each provided with a shield door 306, and said shield door 306 is used to control the opening and closing of the air inlet 3041 and the air outlet 3042. When said chamber 100 is at a high-humidity mode, said air supply is structure 305 blows cold air into the chamber 100 via the air inlet 3041, and the cold air may be blown out from the opened moisture preserving module 303.

In the present embodiment, said chamber further comprises an evaporator (not shown in the figures), said evaporator is used to remove moisture from the air so as to generate dry air, and when said chamber 100 is at a drying mode, said air supply structure 305 blows the dry air dehumidified by the evaporator into said chamber 100 via the air inlet 3041. In one example, said air inlet 3041 is opened, and at the same time said air outlet 3042 is closed, the air supply module 305 feeds the dry air into the chamber 100 via the air channel 3051 and the air inlet 3041 so as to reduce the humidity value in the chamber 100, when a certain amount of dry air is introduced, the air pressure in the chamber 100 increases, the drawer 309 moves slightly and generates a gap under the action of the air pressure, the moisture in the chamber 100 may be discharged via said gap, and when the air supply module 305 stops working, the drawer 309 returns to the original position, the air inlet 3041 is closed, and the chamber 100 becomes a closed space. Therefore, in the above-mentioned example, only an air inlet 3041 is arranged, without the need to arrange an air outlet 3042. In another example, said air inlet 3041 and said air outlet 3042 are both opened, the air supply module 305 blows dry air into the chamber 100 via the air channel 3051 and the air inlet 3041, the dry air drives the air with a relatively high humidity in the chamber 100 to be discharged via the air outlet 3042, and after a certain period of time, the air with a relatively high humidity in the chamber 100 is fully discharged, the air inlet 3041 and the air outlet 3042 are closed, and the chamber 100 becomes a closed space, thereby the chamber 100 implementing the drying function.

In the present embodiment, said moisture preserving film 3033 has a moisture-permeable humidity value, different moisture preserving films 3033 have different moisture-permeable humidity values, the moisture-permeable humidity value may be selected dependent on the optimum humidity value of the products stored in the chamber 100, for example, when the optimum humidity value of the products stored in the chamber 100 is 90%, the moisture preserving film 3033 with a humidity value of 90% may be selected, when the current humidity value of the said chamber 100 is greater than the moisture-permeable humidity value of 90% of the moisture preserving film 3033, said moisture preserving film 3033 has the moisture preserving function, and said moisture preserving film 3033 allows moisture in said chamber 100 to flow out, so that the current humidity value is decreased to the optimum humidity value of 90%; and when said current humidity value is not greater than the moisture-permeable humidity value of 90% of the moisture preserving film 3033, said moisture preserving film 3033 has a moisture preserving function, and said moisture preserving film 3033 prevents the moisture in said chamber 100 from flowing out, so as to increase the current humidity value to the optimum humidity value 90%.

In the present embodiment, said upper cover 310 can regulate the opening or closing of said moisture preserving module 303 in the sliding process. When said chamber 100 is at a high-humidity mode, said upper cover is fully opened, that is, said upper cover 310 at this time is fully exposed out of said moisture preserving module 303, and the high-humidity mode at this time has the optimum effect; and when said chamber 100 is at a drying mode, said upper cover is fully closed, that is, the upper cover 310 at this time completely covers said moisture preserving module 303, and the drying mode at this time has the optimum effect.

The work flow of the multifunctional chamber 100 of the present embodiment is as follows:

when a user places vegetables and fruits which require a high-humidity environment in said chamber 100, the chamber 100 at this time is switched to a high-humidity mode, that is, said air port 304 at this time is closed and the upper cover 310 is fully opened. It is supposed that the optimum humidity value H of the vegetables and fruits is 90%, a moisture preserving film 3033 with the moisture-permeable humidity value Hn of 90% is selected, the moisture preserving module 303 may comprise moisture preserving films 3033 with various moisture-permeable humidity values and in practical applications, a moisture preserving film 3033 with a suitable moisture-permeable humidity value Hn may be selected according to the requirements of the stored products. When the current humidity value H1 of the chamber 100 is 99%, the current humidity value H1 exceeds the moisture-permeable humidity value Hn of the moisture preserving film 3033, the moisture preserving film 3033 at this time has a moisture preserving function, the moisture preserving module 303 allows moisture in the chamber 100 to flow out, and the current humidity value H1 is gradually approaching said moisture-permeable humidity value Hn and is consistent with said moisture-permeable humidity value Hn; and when the current humidity value H2 of the chamber 100 is 80%, the current humidity value H2 does not reach the moisture-permeable humidity value Hn of the moisture preserving film 3033, the moisture preserving film 3033 has a moisture preserving function, the moisture preserving module 3033 prevents the moisture in the chamber 100 from flowing out, and the current humidity value H2 is gradually approaching said moisture-permeable humidity value Hn and is consistent with said moisture-permeable humidity value Hn.

When a user places medicinal materials which require a drying environment in said chamber 100, the chamber 100 at this time is switched to a drying mode, that is, at this time the upper cover 310 completely covers said moisture preserving module 303, and the air inlet 3041 and the air outlet 3042 are opened. The air supply module 305 blows dry air into the chamber 100 via the air channel 3051 and the air inlet 3041, the dry air drives the air with a relatively high humidity in the chamber 100 to be discharged via the air outlet 3042, and after a certain period of time, the air with a relatively high humidity in the chamber 100 is fully discharged, the air inlet 3041 and the air outlet 3042 are closed, and the is chamber 100 becomes a closed space, thereby the chamber 100 implementing the drying function.

hi the present embodiment, said chamber 100 may further comprise a control module which is used to control the switching between the high-humidity mode and the dry mode of the chamber 100, the sliding of the upper cover 310, the opening and closing of the air inlet 3041 and the air outlet 3042, the working of the air supply module 305, etc.

The chamber 100 of the present embodiment can switch between the high-humidity mode and the dry mode according to the requirements of the articles stored in the chamber 100, so as to implement storing articles of different demands in the same chamber 100, thereby achieving the purposed of flexibly regulating the environment of the chamber 100 and reducing the waste of the chamber 100.

The present invention also provides a refrigerator which comprises at least one chamber 100 mentioned above.

It should be understood that, although the description is given according to the embodiments, but each embodiment does not only comprise an independent technical solution, this narrative manner of the description is only for clarity, and for a person skilled in the art, the description shall be regarded as a whole, and the technical solution in each of the embodiments can also be properly combined so as to form other embodiments that can be understood by a person skilled in the art.

The detailed descriptions set forth above are merely specific descriptions directed to the feasible embodiments of the present invention, and they are not intended to limit the scope of protection of the present invention; any equivalent embodiment or alteration of the present invention, made without departing from the technical spirit of the present invention, shall be included within the scope of protection of the present invention.

What is claimed is:

1. A multifunctional chamber, comprising an inner container and a door body for closing said inner container, the inner container being enclosed by a plurality of plate bodies, characterized in that said multifunctional chamber further comprises:

at least one opening provided in at least one of the plurality of plate bodies;

a moisture preserving module provided at said opening, said moisture preserving module being used to regulate and control a humidity of said multifunctional chamber;

an upper cover movably disposed on said moisture preserving module;

and at least one air port provided in at least one of the plurality of plate bodies, said air port being used to discharge moisture from said multifunctional chamber;

wherein said upper cover is configured to when said multifunctional chamber is at a high-humidity mode, said upper cover moves at said moisture preserving module to expose said moisture preserving module; and when said multifunctional chamber is at a drying mode, said upper cover completely covers said moisture preserving module;

wherein said moisture preserving module comprises at least two bases and at least one moisture preserving film, said moisture preserving film is sandwiched between said at least two bases, and each of said at least two bases is provided with at least one air hole; and wherein said moisture preserving module is provided with a first sliding part, said upper cover is provided with a second sliding part corresponding to the first sliding part, and said upper cover slides relative to said moisture preserving module by means of said first sliding part and said second sliding part.

2. The multifunctional chamber according to claim 1, characterized in that said moisture preserving module has a moisture-permeable humidity value wherein said moisture preserving module is configured to when a current humidity value of said multifunctional chamber is greater than said moisture-permeable humidity value, said moisture preserving module allows moisture in said multifunctional chamber to flow out; and when said current humidity value is not greater than said moisture-permeable humidity value, said moisture preserving module prevents the moisture in said multifunctional chamber from flowing out.

3. The multifunctional chamber according to claim 2, characterized in that said moisture preserving module is configured to when said chamber is in said high-humidity mode, said moisture preserving module regulates said current humidity value of said multifunctional chamber, and said current humidity value is approaching said moisture-permeable humidity value and is consistent with said moisture-permeable humidity value.

4. The multifunctional chamber according to claim 1, characterized in that said moisture preserving module is arranged in a sealed manner at said opening.

5. The multifunctional chamber according to claim 1, characterized in that one of said first sliding part and said second sliding part is a chute, and the other of said first sliding part and said second sliding part is a boss.

6. The multifunctional chamber according to claim 1, characterized in that said moisture preserving module is provided with at least one blocking part, and said blocking part is used to prevent said upper cover from being detached from said moisture preserving module.

7. The multifunctional chamber according to claim 1, characterized in that said multifunctional chamber further comprises an air supply module and an evaporator, said at least one air port is an air inlet, said evaporator is used to generate dry air, and when said multifunctional chamber is at the drying mode, said air supply module blows said dry air into said multifunctional chamber via said air inlet.

8. A refrigerator, characterized by comprising:

a multifunctional chamber in which comprises an inner container and a door body for closing said inner container, the inner container being enclosed by a plurality of plate bodies, said multifunctional chamber further comprises:

at least one opening provided in at least one of the plurality of plate bodies;

a moisture preserving module provided at said opening, said moisture preserving module being used to regulate and control a humidity of said multifunctional chamber;

an upper cover movably disposed on said moisture preserving module;

and at least one air port provided in at least one of the plurality of plate bodies, said air port being used to discharge moisture from said multifunctional chamber;

wherein said upper cover is configured to when said multifunctional chamber is at a high-humidity mode, said upper cover moves at said moisture preserving module to expose said moisture preserving module; and when said multifunctional chamber is at a drying mode, said upper cover completely covers said moisture preserving module;

wherein said moisture preserving module comprises at least two bases and at least one moisture preserving film, said moisture preserving film is sandwiched between said at least two bases, and each of said at least two bases is provided with at least one air hole and;

wherein said moisture preserving module is provided with a first sliding part, said upper cover is provided with a second sliding part corresponding to the first sliding part, and said upper cover slides relative to said moisture preserving module by means of said first sliding part and said second sliding part.

* * * * *